US005288030A

United States Patent [19]

Wirtz et al.

[11] Patent Number: 5,288,030

[45] Date of Patent: Feb. 22, 1994

[54] AUTOMATIC POSITIONING DEVICE FOR A YARN END FINDER

[75] Inventors: Ulrich Wirtz; Helmuth Hensen; Wolfgang Irmen, all of Moenchengladbach; Paul Surkamp, Kempen; Helmut Kohlen, Erkelenz; Dietmar Engelhardt; Hans Grecksch, both of Moenchengladbach, all of Fed. Rep. of Germany

[73] Assignee: W. Schlafhorst AG & Co., Moenchengladbach, Fed. Rep. of Germany

[21] Appl. No.: 741,673

[22] Filed: Aug. 7, 1991

[30] Foreign Application Priority Data

Aug. 7, 1990 [DE] Fed. Rep. of Germany ..... 4025003

[51] Int. Cl.[5] ..... B65H 54/00; B65H 69/04

[52] U.S. Cl. ..... 242/18 R; 242/35.6 E

[58] Field of Search ..... 242/18 R, 35.6 E; 28/292, 293, 294; 57/262, 281

[56] References Cited

U.S. PATENT DOCUMENTS

| | | | |
|---|---|---|---|
| 3,203,634 | 8/1965 | Fürst | 242/18 R |
| 3,652,025 | 3/1972 | DiMauro | 242/18 R |
| 3,728,550 | 4/1973 | Cleland, Jr. et al. | 242/35.6 E |
| 4,544,107 | 10/1985 | Matsui et al. | 242/35.5 A |
| 4,598,869 | 7/1986 | Uchida et al. | 57/281 X |
| 4,634,065 | 1/1987 | Küpper et al. | 242/18 R |
| 4,660,780 | 4/1987 | Otoshima | 242/35.6 E |
| 4,739,611 | 4/1988 | Rohner | 57/281 X |
| 4,858,836 | 8/1989 | Tone et al. | 242/18 R |
| 4,901,931 | 2/1990 | Mista | 242/18 R |
| 4,911,371 | 3/1990 | Mista | 242/35.6 E |
| 5,037,036 | 8/1991 | Okuyama | 242/18 R X |
| 5,056,725 | 10/1991 | Wirtz et al. | 242/35.6 E |

*Primary Examiner*—Daniel P. Stodola
*Assistant Examiner*—Michael R. Mansen
*Attorney, Agent, or Firm*—Shefte, Pinckney & Sawyer

[57] ABSTRACT

A yarn end preparing apparatus is provided for drawing off a yarn end of a textile yarn package and thereafter rewinding the drawn out yarn end onto the yarn package at a preferred location thereon. The yarn preparing apparatus includes a suction housing supported on a pair of vertical guide rods for movement parallel to the axis of a yarn package to be prepared. A pair of linkage members, each comprising a conduit, are pivotably connected to one another with their respective conduits communicated with one another for applying suction through the conduits to the suction housing to thereby effect drawing in of a yarn end through a suction slot of the suction housing. A light beam emitting member is mounted forwardly of the suction slot for emitting a light beam detected by a light beam detecting member mounted on an opposite forward side of the suction slot. During downward movement of the suction housing to dispose the suction slot adjacent the tapered top portion of a yarn package, the light beam is interrupted by the body of yarn on the yarn package as the suction slot reaches an optimal spacing from the yarn package and a control unit stops the movement of the suction housing in response to the interruption of the light beam to automatically position the suction slot at a predetermined optimal spacing from the tapered top portion of a yarn package independent of the relative axial position of the tapered top portion.

26 Claims, 3 Drawing Sheets

AUTOMATIC POSITIONING DEVICE FOR A YARN END FINDER

BACKGROUND OF THE INVENTION

The present invention relates to an apparatus for preparing a yarn end of a textile yarn package having means for automatically positioning a suction slot relative to a yarn package and, more particularly, an apparatus having an automatic positioning means which automatically positions a suction slot at a predetermined spacing from the tapered top portion of a yarn package.

The pace of improvements in developing more efficient textile winding machines has produced a corresponding need to improve the efficiency of textile spinning machines which build the yarn packages supplied to the winding machines for winding thereat. In this regard, improvements in textile spinning machines which reduce the need for human operator intervention—in other words, improvements which contribute to the automatic operation of the machine—are especially helpful improvements in increasing the efficiency and cost effectiveness of an integrated textile spinning and winding operation.

One area of an integrated textile spinning and winding operation which has received attention, as reflected by the issuance of several patents, is the yarn end preparation area which relates to the preparation of the yarn ends of textile yarn packages after such packages have been built at a textile spinning machine in preparation for the unwinding of these yarn packages at a textile winding machine. Since the efficiency of the subsequent unwinding operation can be improved by finding and positioning a yarn end of a textile yarn package at a preferred disposition on the yarn package prior to the delivery of the yarn package to a winding station of a textile winding machine for unwinding thereat, numerous devices have been proposed for finding and positioning the yarn ends of textile yarn packages. Moreover, several devices have been proposed for finding and preparing the yarn ends of those yarn packages which have already been subjected to at least an initial yarn end preparation step during which an attempt to locate and/or position a yarn end was unsuccessful. For example, DE-PS 30 45 825 proposes a device operable to continuously circulate textile yarn packages in a closed loop to repetitively bring the yarn packages to several yarn end preparation devices adjacent the closed loop. However, this device does not fully optimize the yarn end preparation step since textile yarn packages may frequently travel several times around the closed loop without successful preparation of a yarn end thereof and these textile yarn packages correspondingly decrease the efficiency of the yarn end preparation process.

DE-PS 32 35 442 also proposes a yarn end preparation device having a circuit through which textile yarn packages are circulated past several yarn end preparation assemblies. The proposed device includes a counter means which counts the number of circuits which a particular textile yarn package has completed and controls a separation assembly which separates those yarn packages which have circulated more than a predetermined number of times around the circuit, such yarn packages being deemed to be unworkable in that no yarn end thereof has been successfully prepared. However, this proposed device still leaves opportunities for optimizing the number of successfully prepared yarn packages per unit time. Accordingly, the need exists for an apparatus for preparing a yarn end of a textile yarn package which is operable to efficiently prepare the yarn ends of those yarn packages which typically are not initially successfully handled by the known prior art yarn end preparation devices.

SUMMARY OF THE INVENTION

Briefly described, in one aspect of the present invention, there is provided an apparatus for preparing an end of yarn of a textile yarn package, the yarn package having a body of yarn formed on a tube, the tube having one end and an opposed end and the body of yarn having at least one tapered portion tapering inwardly from an inclined transition location toward a respective end of the tube. The yarn end preparing apparatus includes means for applying suction, the suction applying means including a slot through which suction is applied to a yarn package to effect drawing of a yarn end of the yarn package through the slot interiorly of the suction applying means. Also, the apparatus includes means for automatically positioning the suction slot at a predetermined spacing from the tapered portion of the body of yarn of the yarn package independent of the axial position of the inclined transition location at which the tapered portion of the body of yarn of the yarn package tapers inwardly. The automatically positioning means is operable to position the suction slot at the predetermined spacing for application of suction through the suction slot to effect drawing in of a yarn end on the tapered portion of the body of yarn into the suction applying means.

The suction applying means preferably includes a suction housing forming the suction slot and the automatically positioning means preferably includes means for movably supporting the suction housing for guided movement thereof in a direction in which the suction slot is moved generally parallel to the axis of the yarn package and drive means for moving the suction housing along the movably supporting means. Also, the automatically positioning means preferably includes detecting means, mounted to the suction housing for movement therewith, for providing a stop movement signal in response to the detection by the detecting means of the respective yarn package, and control means for controlling the drive means to stop the guided movement of the suction housing along the movably supporting means upon receipt of a stop movement signal from the detecting means.

According to one feature of the one aspect of the present invention, the automatically positioning means includes means for adjustably orienting the suction slot at a predetermined inclination corresponding to the inclination of the tapered portion of the body of yarn of the yarn package.

According to another feature of the present invention, the detecting means includes a light beam emitting component and a light beam detecting component operable to generate a stop movement signal in response to an interruption of a light beam emitted by the light beam emitting component. The light beam emitting component is mounted to the suction housing at an orientation for emitting a light beam along a path into the spacing between the tapered portion of the yarn package and the suction slot, whereby the drive means is operable to move the suction housing in guided movement along the movably supporting means such that the suction slot moves parallel to the package axis from a start position axially beyond the respective end of the tube. The spacing between the suction slot and the tapered portion of the yarn package correspondingly narrows during the movement of the suction slot in a direction from the respective end of the tube toward the other end of the tube, and the tapered portion of the respective yarn package interrupts the light beam emitted by the light beam emitting component in correspondence with the narrowing of the spacing between the suction slot and the tapered portion of the yarn package to the predetermined spacing.

In another feature of the present invention, the apparatus also includes mounting means for mounting the light beam emitting component and the light beam detecting component on respective opposite lateral sides of the suction slot at a spacing from the suction slot toward the package wherein a light beam emitted by the light beam emitting component travels transversely across the spacing between the suction slot and the tapered portion of the yarn package.

According to additional features of the one aspect of the present invention, the mounting means includes a pair of projecting portions formed on the suction housing, each projecting portion being disposed on a respective lateral side of the suction slot and supporting a respective one of the light beam emitting component and the light beam detecting component. Also, the movably supporting means preferably includes at least one vertical guide member along which the suction housing is relatively moved and the drive means includes means for driving the suction housing relatively along the vertical guide member at variable speeds. Moreover, the drive means preferably includes a motor operatively connected to the detecting means and first and second linkage members, the first linkage member having one end movably connected to the suction housing and its other end movably connected to an end of the second linkage member and the second linkage member is operatively coupled to the motor for driving of the second linkage member to effect guiding movement of the suction housing relatively along the vertical guide member of the movably supporting means.

Each linkage member preferably includes a conduit means forming a conduit, the conduit means of the first linkage member being communicated with the suction housing and the conduit means of the second linkage member being communicated with a suction source for applying suction through the conduit means of the first and second linkage members and the suction slot to thereby effect the drawing in of a yarn end through the suction slot and into at least the conduit means of the first linkage member. Also, the second linkage member is pivotably mounted to a pivot and the drive means includes a crank arm having one end fixedly mounted to a drive shaft of the drive motor and another end pivotably mounted to the second linkage member at a spacing from the pivot for driving the pivot of the second linkage member about the pivot. Additionally, the drive means includes a worm gear assembly and a drive linkage operatively interconnecting the worm gear assembly with the second linkage member, the drive motor being operable to drive the worm gear assembly.

According to yet further features of the one aspect of the present invention, the motor has an output shaft and the drive means includes a disk mounted to the output shaft of the motor and having a plurality of magnets mounted thereto along a circumferential portion thereof, each magnet having an opposite polarity than the respective adjacent magnet, and magnet sensing means for sensing movement therepast of the magnets during rotation of the output shaft motor, and the control means is operatively connected to the magnet sensing means for controlling the operation of the motor in response to sensing of the magnets by the magnet sensing means. Also, the suction housing preferably includes a carriage portion movably supported by the movably supporting means and a suction slot portion pivotably mounted to the carriage portion, and means for adjustably orienting the suction slot at a predetermined inclination corresponding to the inclination of the tapered portion of the body of yarn of the yarn package, the adjustably orienting means including means for adjustably varying the angular orientation of the suction slot portion relative to the carriage portion.

According to a further additional feature of the one aspect of the present invention, the apparatus includes means for effecting pivoting of the suction slot portion to a predetermined angular orientation relative to the carriage portion, the pivot effecting means being positioned relative to the movably supporting means for effecting pivoting of the suction slot portion relative to the carriage portion to a selected angular orientation and including an inclined surface, the inclined surface of the pivot effecting means effecting pivoting of the suction slot portion relative to the carriage portion. Preferably, the suction slot portion includes a roller for rolling travel along the inclined surface of the pivot effecting means.

According to yet an additional feature of the one aspect of the present invention, the apparatus includes jet nozzle means mounted to the suction housing and pressurized air supply means operatively connected to the jet nozzle means, the jet nozzle means for applying pressurized air tangentially to the body of yarn of the yarn package to effect loosening of a yarn end therefrom. According to another additional feature, the apparatus includes means for mechanically working the yarn package, the mechanically working means being mounted to the suction housing and including means for moving the mechanically working means relative to the outer surface of the body of yarn of the yarn package to effect mechanical working of the yarn package. The mechanically working means includes an abrasive surface and means for cyclically moving the abrasive surface into and out of contact with the outer surface of the body of yarn of the yarn package. Also, the means for cyclically moving the abrasive surface includes a drive disk mounted for eccentric rotation, one end of the drive arm pivotably secured to the drive disk and an opposed end of the drive arm supporting the abrasive surface, and pivot support means pivotably mounted to the drive arm at a location spaced from the one end of the drive arm pivotably coupled to the drive disk, the drive disk being operative to cyclically reversibly pivot the drive arm relative to the pivot support member to thereby effect cyclic movement of the abrasive surface toward and away from the yarn package and the abrasive surface being positioned for contacting the yarn package upon downward movement of the abrasive surface.

According to yet further features of the one aspect of the present invention, the suction applying means includes yarn end detecting means for detecting the presence or absence of a yarn end drawn into the suction applying means, the control means being operable to activate the mechanically working means in response to the absence of a signal from the yarn end detecting means indicating the presence of a yarn end before the lapse of a predetermined period of time. Also, the apparatus includes means for cutting a drawn in yarn end, the yarn end cutting means being mounted in the conduit means of a selected one of the first and second linkage members for cutting a yarn end drawn into the conduit means of the selected linkage member. Moreover, the yarn end cutting means preferably includes means for blocking the conduit means of the selected linkage member in correspondence with the cutting of a yarn end by the yarn end cutting means, the blocking means being operable to block the flow of suction past the location at which the yarn end cutting means cuts a drawn in yarn end.

In another aspect of the present invention, there is provided an apparatus for preparing an end of yarn of a textile yarn package, the yarn package having a body of yarn formed on a tube, the tube having one end and an opposed end and the body of yarn having at least one tapered portion tapering inwardly from an inclined transition location toward a respective end of the tube. The yarn end preparing apparatus includes means for applying suction, the suction applying means including a suction slot portion forming a slot through which suction is applied to a yarn package to effect drawing of a yarn end of the yarn package through the slot interiorly of the suction slot portion and a carriage portion to which the suction slot portion is movably mounted for movement about a movement axis.

Also, the suction applying means includes means for movably supporting the carriage portion for guided movement thereof in a direction in which the carriage portion is moved generally parallel to the axis of the yarn package and drive means for moving the carriage portion along the movably supporting means. The yarn end preparing apparatus also includes means for re-orienting the suction slot at a predetermined inclination corresponding to the inclination of the tapered portion of the body of the yarn package from an inclination different from the predetermined inclination, the re-orienting means being operable to effect movement of the suction slot portion about the movement axis in correspondence with movement of the carriage portion along a selected portion of the movably supporting means, whereby the suction slot can be positioned for drawing in a yarn end on the tapered portion of the body of the yarn package into the suction applying means.

DETAILED DESCRIPTION OF THE PREFERRED EMBODIMENT

Figures 1, 2:
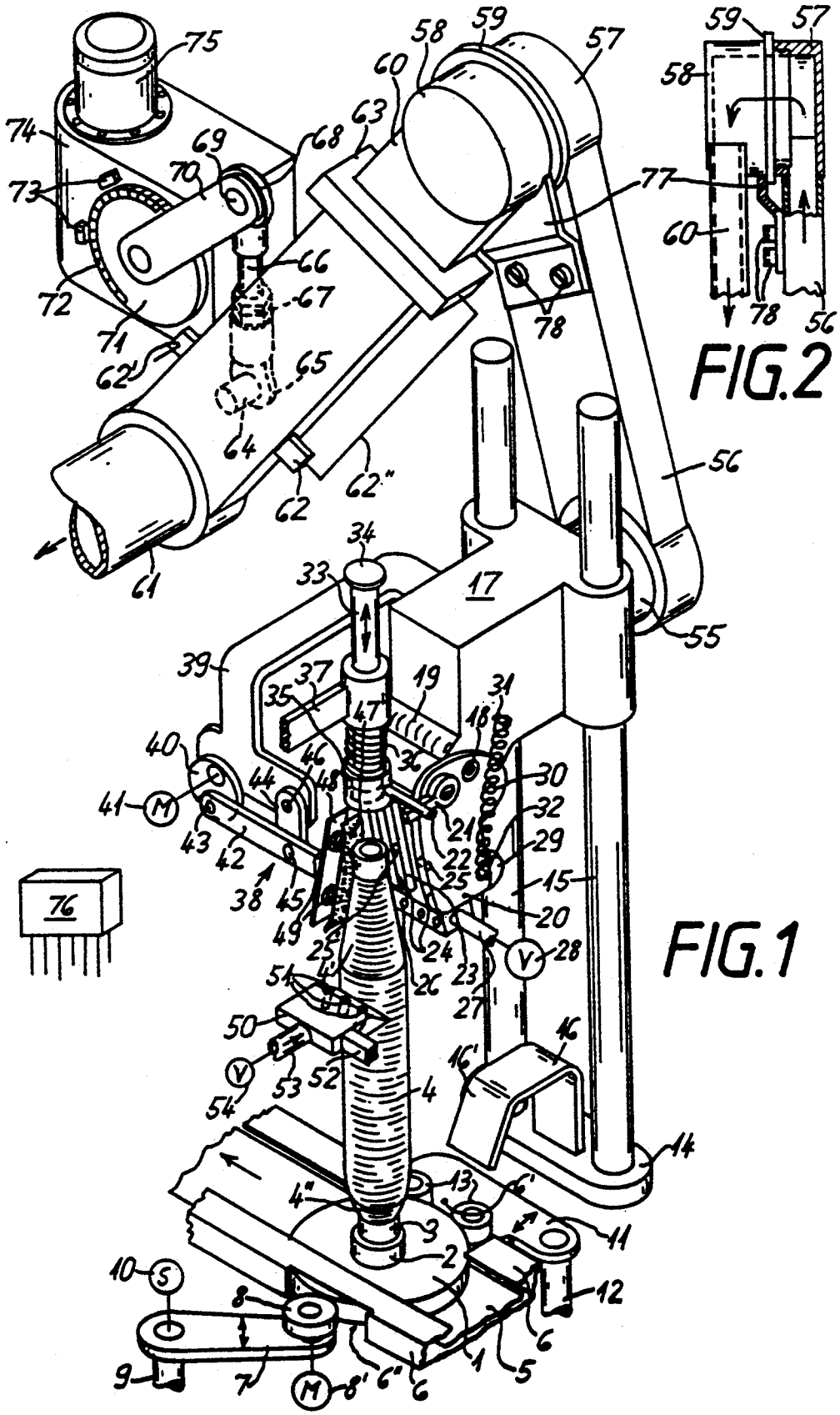
FIG. 1 is a perspective view of the preferred embodiment of the yarn end preparation apparatus of the present invention, showing the apparatus in a ready position for commencing a yarn end preparation operation on a textile yarn package.
FIG. 2 is a front elevational view, in partial vertical section, of a portion of the yarn end preparation apparatus shown in FIG. 1.
Figure 3:
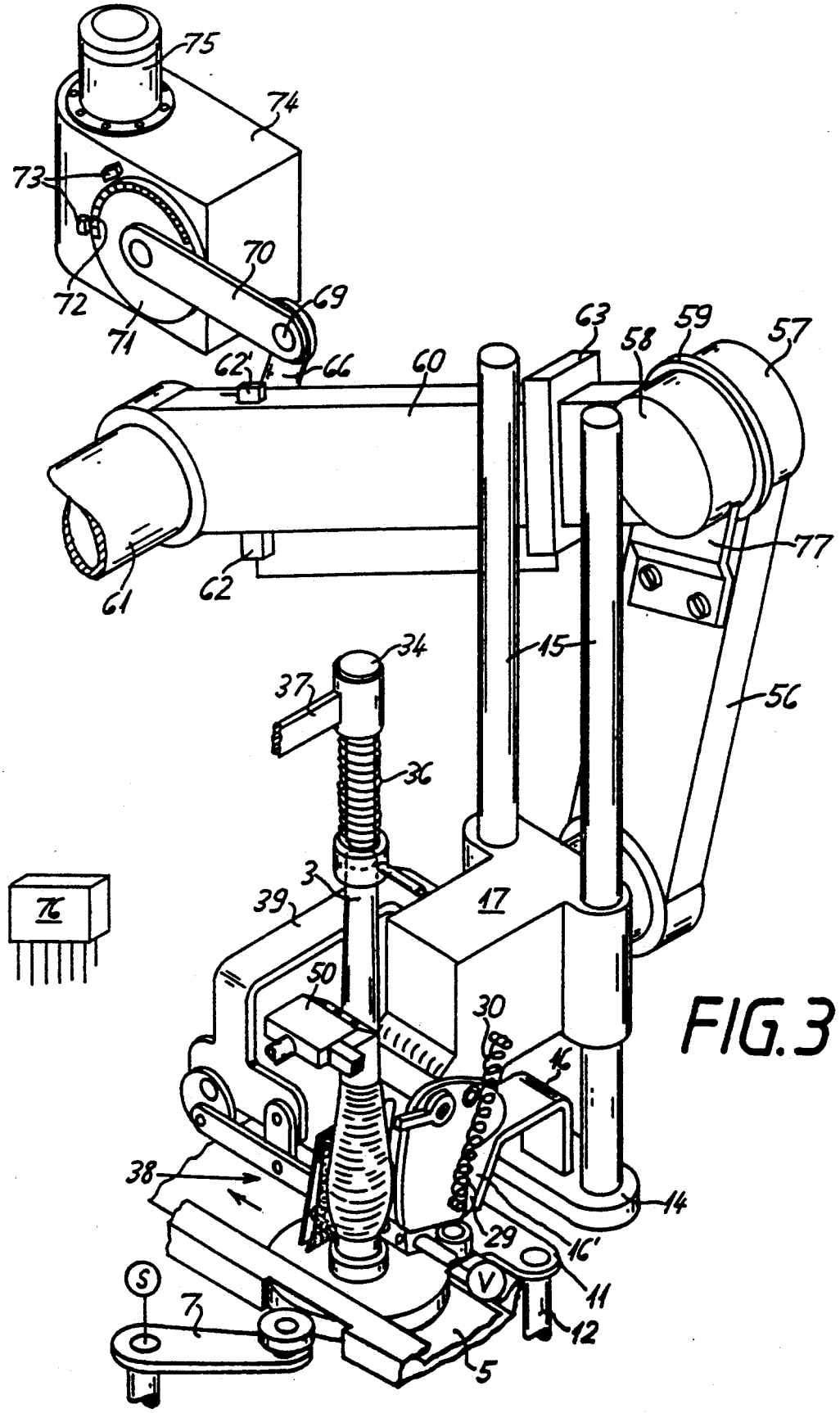
FIG. 3 is a perspective view of the yarn end preparation apparatus shown in FIG. 1, showing the apparatus in an operating position for removing the remaining yarn on a partially unwound textile yarn package.

In FIGS. 1-3, the preferred embodiment of the yarn end preparation apparatus of the present invention is illustrated. The yarn end preparation apparatus is operable to prepare the yarn ends of textile yarn packages following the building thereof at, for example, a textile spinning machine (not shown) and prior to the delivery of such textile yarn packages to another textile machine for handling of the yarn packages such as, for example, a textile winding machine (not shown) having a plurality of winding stations, each for unwinding the yarn of the yarn package to build other yarn packages from the unwound yarn. As seen in FIG. 1, the yarn end preparation apparatus is positioned adjacent a travel path formed by a conventional endless belt transport assembly 5 along which textile yarn packages, of which a yarn package 4 is representatively shown, are continuously transported from one handling location to another handling location. The transport assembly 5 includes a portion extending to and through a preparation location at which the yarn end preparation apparatus prepares the yarn ends of the yarn packages supported thereat on the caddies 1.

The yarn package 4 is of the type having a body of yarn which has been built on a cylindrical tube 3 with a tapered top portion 4' of the body of yarn tapering inwardly from an incline transition location in the direction from the bottom of the tube 3 towards its top and with a bottom axial portion 4'' of the body of yarn tapering inwardly from the top of the tube 3 towards its bottom. Additionally, the yarn package 4 is supported in an upright disposition on a conventional individual tube support member or caddie 1 of the type having an annular base portion, an annular neck portion 2 of relatively lesser diameter than the annular base portion and mounted co-axially thereto, and a peg portion (not shown) for the insertion thereover of the bottom portion of the tube 3.

The endless belt transport assembly 5 comprises an endless belt having an upper run traveling in the direction shown by the arrow in FIG. 1, the endless belt being supported in a frame which includes a pair of opposed flange portions 6 each having an overhang portion extending laterally inwardly of the endless belt for engaging the top surface of the annular base portion of each caddie 1 during its transport by the transport assembly 5 to maintain the caddie 1 in frictional engagement with the endless belt. The flange portions 6 are formed with a lateral opening 6',6'', respectively, at a preparation location along the travel path of the transport assembly 5 for permitting access of the components of a caddie rotation assembly to the respective caddie 1 positioned at the preparation location. The caddie rotation assembly includes a first pivot arm 7 having one end pivotably mounted to a pivot shaft 9. A drive roller 8 is rotatably mounted to the other end of the pivot arm 7 and is operatively connected to a roller drive motor 8' for driving rotation of the drive roller 8. A conventional pivot drive means such as, for example, a pivot solenoid 10, is operatively connected to the pivot arm 7 to effect pivoting of the pivot arm about the axis of the pivot shaft 9.

A second pivot arm 11 has one end pivotably mounted to a second pivot shaft 12 and is disposed opposite the pivot arm 7 on the opposed lateral side of the endless belt of the transport assembly 5. A pair of positioning rollers 13 are each rotatably mounted to the second pivot arm 11 at spaced apart positions thereon. A conventional drive motor (not shown) is operatively connected to the second pivot shaft 12 to selectively pivot the pair of positioning rollers 13 in to the opening 6' in the one respective flange portion 6 for rolling engagement of the positioning rollers 13 with the respective caddie 1 at the preparation location and for pivoting the pair of positioning rollers 13 out of engagement to permit the respective caddie 1 to be further transported by the endless belt of the transport assembly 5. The pair of positioning rollers 13 cooperate with the drive roller 8 to temporarily maintain the caddie 1 at the preparation location by compressive engagement of the caddie between the pair of positioning rollers 13 and the drive roller 8. Additionally, the drive roller 8 is operable to selectively drive the caddie 1 in one rotation direction with respect to the axis of the yarn package 4 supported thereon corresponding to a winding direction of the yarn on the yarn package and to rotate the caddie 1 in an opposite rotation direction corresponding to the unwinding direction of yarn on the yarn package 4. The drive motor 8', the pivot solenoid 10 and the conventional drive motor associated with the pivot arm 11 are each operatively connected to a control unit 76.

The yarn end preparation apparatus comprises a suction housing 17 having a carriage portion and a suction slot portion 20, the suction slot portion 20 forming a suction slot 23 therein. The yarn end preparation apparatus also includes means for automatically positioning the suction slot 23 at a predetermined spacing from the tapered top portion 4' of each yarn package 4 independent of the axial position of the tapered top portion 4' on the tube 3 of the respective yarn package 4. The suction slot portion 20 is pivotably mounted to the carriage portion by a pivot 18.

The yarn end preparation apparatus also includes means for movably supporting the suction housing for guided movement thereof in a direction in which the suction slot 23 is moved generally parallel to the axis of the yarn package 4 at the preparation location. The movably supporting means includes a pair of upright cylindrical rods 15 mounted to a base 14 and spaced apart from one another in the direction of the travel path of the caddies 1 along the transport assembly 5. The carriage portion of the suction housing 17 is formed with a pair of cylindrical through bores, each of a diameter slightly greater than the diameter of one of the cylindrical rods 15 and the cylindrical through bores are spaced from one another at the same spacing as the pair of cylindrical rods 15 for receipt of one respective cylindrical rod 15 in each respective cylindrical through bore in the carriage portion of the suction housing 17.

As seen in FIGS. 1 and 2, the yarn end preparing apparatus includes a drive means for moving the suction housing 17 along the cylindrical rods 15 and the drive means comprises a drive motor 75 mounted to a worm gear assembly 74. The worm gear assembly 74 includes a worm gear (not shown) meshingly engaged with an output shaft on which an output control disk 71 is fixedly mounted. A plurality of magnets 72 are mounted along a circumferential portion of the output control disk 71. A pair of magnetic sensors 73 in the form, for example, of Hall sensors, are disposed adjacent the circumference of the output control disk 71 at circumferentially spaced positions for sensing the travel therepast of the magnets 72 in a manner described in more detail below. The drive motor 75 is operatively connected to the control unit 76.

The drive means also includes a first linkage arm 56 having a hollow interior. One end of the first linkage member 56 is communicated via an interconnecting conduit 55 with the carriage portion of the suction housing 17. The other end of the first linkage member 56 is pivotably connected with one end of a second linkage member 60. The second linkage member 60 has a hollow interior communicated with the hollow interior of the first linkage member 56 and the other end of the second linkage member 60 is communicated with, and pivotably mounted to, a conduit 61. A conventional suction source (not shown) is provided for applying a suction through the conduit 61, the linkage members 60,56 and the interconnecting conduit 55 to the suction housing 17 for drawing a yarn end through the suction slot 23 in the suction housing 17.

The interconnected ends of the linkage members 56,60 are connected via an arrangement such that their respective hollow interiors are communicated with one another throughout the range of relative pivotal movement between the two linkage members. The arrangement includes a cylindrical end portion 58 formed on the one end of the second linkage member 60 having a radially enlarged flange 59. The one end of the first linkage member 56 includes a cylindrical portion 57 of lesser diameter than the outer diameter of the radially enlarged flange 59 yet greater than the inner diameter of the radially enlarged flange portion. Each of the cylindrical portions 57,58 are open on the respective side thereof facing toward the other cylindrical portion.

The cylindrical portion 57 of the first linkage member 56 is maintained in sealed contact with the radially enlarged flange 59 by a securing bracket 77 which is fixedly mounted via a pair of bolts 78 to the first linkage member 56 and includes an arcuate surface at its free end of a curvature corresponding to the circumference of the cylindrical portion 58 of the second linkage member 60. The securing bracket 77 is mounted in relative sliding engagement with one respective side of the radially enlarged flange 59 and is operable to maintain the cylindrical portion 57 in sealing engagement with the other side of the radially enlarged flange 59 throughout the range of pivotal movement of the first linkage member 56 and the second linkage member 60 relative to one another.

To operatively connect the drive motor 75 with the linkage member 56,60 for driving of the suction housing 17 an output arm 70 is provided which is fixedly mounted to the end of the output shaft of the worm gear assembly 74 and the free end of the output arm 70 is pivotably connected via a pivot shaft 69 to a threaded portion 68 of an arm 66. An adjustment portion 65 of the arm 66 is pivotably connected via a pivot shaft 64 to the second linkage member 60 and is adjustably connected via a bolt and nut arrangement 67 to the threaded portion 68 of the arm 66. The length of the arm 66 is variable via adjustment of the bolt and nut arrangement 67 to selectively vary the distance between the pivot shaft 66 mounted to the output arm 70 and the pivot shaft 64 mounted to the second linkage member 60.

Each magnet 72 has an opposite polarity than the respective magnet on each respective side thereof. The magnetic sensor 73 is operable to generate a different impulse signal in response to the passage thereby of each magnet 72 of a predetermined polarity and the control unit 76 accordingly evaluates the two different kinds of impulse signals from the magnet sensor 73 to determine the magnitude of the angular movement of the output disk 71. For example, the greater the number of impulse signals received from the magnetic sensor 73, the greater the magnitude of the angular movement of the output disk 71 in a respective direction of rotation. Through this arrangement, the magnitude of the vertical movement of the suction housing 17 can be controlled independently of the relative position of the tapered top portion 4' of the respective yarn package 4 at the preparation location.

A yarn end detecting means is provided for detecting the presence or absence of a yarn end drawn into the linkage members 56,60 and includes a conventional light beam emitting component 62' such as, for example, a photodiode, operable to emit a light beam into the second linkage member 60. A light beam detecting component 62 is operatively connected via a connector 62" to a conventional yarn end cutting device 63 mounted on the second linkage member upstream of the light beam detecting component 62 relative to the direction of travel of suction through the second linkage member and is operable to detect the interruption of a light beam by a drawn in yarn end. The yarn end cutting device 63 is preferably in the form of a device which additionally blocks the passage of suction therethrough in coordination with the cutting of a yarn end.

The yarn end preparation apparatus also includes an auxiliary yarn end loosening assembly 38 comprising a rigid support arm 39 fixedly mounted to the carriage portion of the suction housing 17 and projecting forwardly therefrom. A drive disk 40 is eccentrically rotatably mounted to the rigid support arm 39 and is operatively connected to a drive motor 41 for eccentric rotation of the drive disk 40. An arm 42 has one end pivotably mounted by a pivot shaft 43 to the drive disk 40 diametrically opposite the pivot mounting of the drive disk 40 to the rigid support arm 39. A support arm 44 has one end mounted by a fastener 46 to the rigid support arm 39 and another end pivotably mounted by a pivot shaft 45 to the arm 42 at a spacing from the pivot shaft 43. A plate 48 is fixedly mounted to the free end of the arm 42 and a pair of springs 49 resiliently mount an abrasive member 47 to the plate 48. The abrasive member 47, which can comprise, for example, an abrasive covered surface such as rubber, is supported by the plate 48 at an inclination generally corresponding to the inclination of a tapered top portion 4' of an average yarn package 4. By eccentric rotation of the drive disk 40 by the drive motor 41, the arm 42 is cyclically moved to bring the abrasive member 47 into abrasive engagement with the tapered top portion 4', thereby facilitating loosening of a yarn end thereon.

To facilitate loosening of a yarn end on the tapered top portion 4' of a yarn package 4 at the preparation location, the yarn end preparation apparatus additionally includes a first plurality of jet nozzles 26 all communicated via a conduit 27 with a conventional pressurized air source (not shown). A valve 28 is operatively connected to the conduit 27 to selectively control the supply of pressurized air to the jet nozzles 26. The jet nozzles 26 are fixedly mounted to the bottom surface of the suction slot portion 20 and are oriented for applying jets of pressurized air tangentially against the yarn on the tapered top portion 4' of a yarn package 4 to facilitate loosening of a yarn end therefrom. A second plurality of jet nozzles 51 are mounted in a jet nozzle housing 50 which is supported by a frame 52 at a location for the jet nozzles 51 to direct streams of air tangentially against the tapered top portion 4' of a yarn package 4 at the preparation location. The jet nozzles 51 are connected via a conduit 53 with a conventional source of pressurized air (not shown) and a valve 54 is operatively connected to the conduit 53 for selectively controlling the supply of pressurized air to the jet nozzles 51. The housing 50 is disposed opposite the first plurality of the jet nozzles 26 in a direction transverse to the travel direction of the yarn packages 4 for the application of jets of pressurized air against the tapered top portion 4' of a yarn package 4.

The yarn end preparation apparatus further includes a yarn package centering assembly including a sleeve member 37 mounted at a fixed height at the preparation location and a cylindrical rod 33 movably supported in a cylindrical through bore of the sleeve 37 for axial movement of the cylindrical rod 33 therein. The top end of the cylindrical rod 33 is formed with a radially enlarged cap 34 for limiting movement of the cylindrical rod 33 in one axial direction thereof relative to the sleeve 37. A tube contact member 35 is fixedly mounted to the other end of the cylindrical rod 33 and a spring 36 is compressively disposed between the tube contact member 35 and the underside of the sleeve 37 for resiliently biasing the cylindrical rod 33 to move in a downward axial direction. A trip arm 22 projects radially from the tube contact member 35. The tube contact member 35 is formed with an annular recess on its underside of slightly greater diameter than the outer diameter of a tube 3 and, preferably, a surface element is rotatably mounted in the annular recess of the tube contact member 35 for engagement by the top surface of a tube 3 for rotation therewith during rotation of the tube 3. The tube contact member 35 is selectively movable into contact with the top of the tube 3 of the respective yarn package 4 at the preparation location to maintain the respective yarn package 4 in a vertically upright and centered position at the preparation location during the preparation of a yarn end thereon as well as to minimize the uncontrolled removal of a bunch winding which may be present on the top portion of the tube 3 of the respective yarn package 4.

The cylindrical rod 33 can be configured instead as a rod with a non-annular cross-sectional shape and the through bore of the sleeve 37 can be configured with a corresponding non-annular cross-sectional area compatible with the shape of the rod 33 such that the rod 33 can freely axially move relative to the sleeve 37 while movement of the rod 33 in a radial direction is limited.

As seen in FIG. 1, the suction housing 17 includes a flexible sealing component 19 operable to continuously seal the interface between the carriage portion of the suction housing 17 and the suction slot portion 20 throughout the range of pivotal movement of the suction portion 20 relative to the carriage portion. The flexible sealing component 19, which can comprise any conventional resiliently flexible sealing material, flexes in correspondence with the pivotal movement of the suction slot portion 20 to maintain the connection opening of the suction slot portion 20 in sealed communication with the output opening of the suction housing 17.

The carriage portion of the suction housing 17 comprises an input opening and an output opening, the output opening being sealingly communicated with a communicating opening in the suction slot portion 20 for the application of suction through the suction slot 23, the suction slot portion 20 and the carriage portion of the suction housing 17. The output opening of the carriage portion of the suction housing 17 is preferably of relatively lesser cross-sectional area than the communication opening of the suction slot portion 20 and this size relationship insures that the entire cross-sectional area of the output opening of the carriage portion is communicated with the suction slot portion 20 throughout the range of pivotal movement of the suction slot portion 20.

Figure 4:
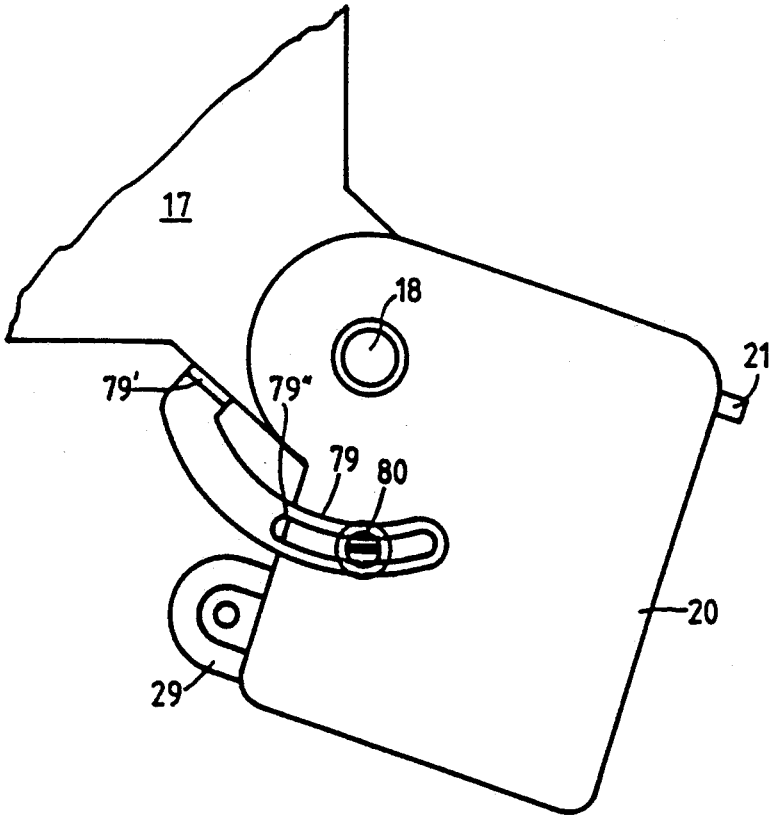
FIG. 4 is a side elevational view of the suction housing and its adjustably orientable suction slot portion.

The axis of the pivot 18 about which the suction slot portion 20 pivots extends generally parallel to the direction of travel of the caddies 1 being transported by the transport assembly 5. The suction slot portion 20 is pivotal about the axis of the pivot 18 to pre-position the suction slot 23 in an orientation in which it is parallel to the taper of the tapered top portion 4' of the yarn packages 4 being prepared by the yarn end preparation apparatus. As shown in FIG. 4, to maintain the suction slot portion 20 at the desired pivoted position in which the suction slot 23 is inclined in the selected inclination, a backstop member 79 is mounted to the underside of the carriage portion of the suction housing 17 and is operable to engage at 79' the back side of the suction slot portion 20 oppositely the side on which the suction slot 23 is formed to prevent further pivoting of the suction slot portion 20 in a clockwise (counter-clockwise in FIG. 1) direction about the pivot 18. The backstop member 79 is adjustable at 79'', 80 to vary the position at which the counterclockwise pivoting of the suction slot portion 20 is stopped. A coil spring 30 has one end mounted to a mounting component 31 on the carriage portion of the suction housing 17 and its other end mounted to a mounting component 32 on the suction slot portion 20 to resiliently bias the suction slot portion 20 against the backstop member.

The suction slot portion 20 includes a pair of projections which each extend forwardly of the suction slot 23 on a respective lateral side of the suction slot. A light beam emitting member 25 is mounted in one projection and is operable to emit a light beam across the front of the suction slot 23 to be received by a light beam detecting component 25' mounted in the other projection.

A release arm 21 is fixedly mounted to the suction slot portion 20 and projects forwardly therefrom transversely of the travel direction of the caddies 1 inwardly of the transport assembly 5. The release arm 21 is operable to engage the trip arm 22 on the tube contact member 35 to raise the tube contact member 35 against the bias of the spring 36 in correspondence with upward vertical movement of the suction slot portion 20 and to control the downward movement of the tube contact member 35 under the biasing action of the spring 36 in correspondence with downward movement of the suction slot portion 20.

As seen in FIGS. 1 and 3, the yarn end preparation apparatus also includes a pivot promoting bracket 16 fixedly mounted to the base 14 intermediate the cylindrical rods 15. The pivot promoting bracket 16 extends transversely of the travel direction toward the preparation location and includes a sloped free end portion 16' inclined at a predetermined angle to effect pivoting of the suction slot portion 20 in a clock-wise direction about the pivot 18 to an outward pivot position in which the suction slot 23 is optimally positioned for engaging a yarn end of a partially wound yarn package. To facilitate smooth outward pivoting of the suction slot portion 20, the suction slot portion 20 is provided with a roller 29 on its backside extending thereacross and positioned for rolling movement along the sloped free end portion 16' of the pivot promoting bracket 16. The roller 29 rolls along the sloped free end portion 16' in correspondence with continued downward movement of the suction slot portion 20 and thereby effects positioning of the suction slot 23 at an optimal predetermined distance from the outer surface of the body of yarn still remaining on the tube 3 of the partially wound yarn package 4 at the preparation location.

The yarn end preparation apparatus operates as follows to prepare the yarn end of a yarn package 4 having a tapered top portion 4'. The suction housing 17 is initially positioned at a ready position for movement of the suction housing therefrom to bring the suction slot 23 into its predetermined optimal spacing from the yarn package at the preparation location. In the ready position of the suction housing 17, the suction slot 23 is inclined at generally the same inclination as the tapered top portion 4' of the yarn package 4 to be prepared and the suction slot 23 is positioned with at least its upper end being radially intermediate the tube 3 and the outer surface of the cylindrical portion of the body of yarn on the yarn package 4 so that, upon downward movement of the suction slot 23 in a direction parallel to the axis of the yarn package, the light beam emitted across the front of the suction slot 23 will be intersected by the tapered top portion 4' of the yarn package.

Typically, each yarn package of a series of yarn packages to be prepared by the yarn end preparation apparatus is identically shaped and comprises a tapered top portion 4' at a uniform inclination. Prior to the handling of the first of such a series of yarn packages, the suction slot 23 is adjusted to an inclined orientation in which it extends parallel to the tapered surface of the tapered top portion 4' of a yarn package and this orientation adjustment is accomplished by adjusting the backstop member projecting from the carriage portion of the suction housing 17 to a corresponding position in which the suction slot portion 20 is pivoted under the biasing action of the coil spring 30 against the backstop member.

The respective yarn package 4 which has just had its yarn end prepared by the yarn end preparation apparatus is released from the preparation location to permit movement of the respective yarn package 4 into the preparation location for preparation of its yarn end. The release of the immediately prior yarn package 4 is effected through appropriate control by the control unit 76 of the pivot arms 7,11 to pivot the rotation roller 8 and the guide rollers 13 out of engagement with the annular base portion of the caddie 1 on which the immediately prior yarn package 4 is mounted and the endless belt of the transport assembly 5 further advances the immediately prior yarn package in the travel direction upon its release from the rollers 8 and 13.

The respective yarn package 4 whose yarn end is to be prepared is then advanced by the endless belt to the transport assembly 5 into the preparation location and the control unit 76 controls the pivot arm 7,11 to pivot their respective rollers 8,13 into engagement with the circumference of the annular base portion of the caddie 1 on which the respective yarn package 4 is mounted. The engagement of the caddie 1 at three circumferentially spaced location by the rollers 8,13 acts to maintain the caddie 1 at the preparation location.

In correspondence with the positioning of the caddie 1 at the preparation location, the control unit 76 controls the valve 54 to permit the supply of pressurized air through the conduit 53 to the jet nozzles 51 which thereby direct jets of pressurized air against the top portion of the tube 3 of the respective yarn package 4. In the event that windings of yarn are present on the top portion of the tube 3 such as, for example, a so-called bunch winding, the action of the jets of pressurized air from the jet nozzles 51 act to loosen the windings of yarn and to drive the loosened windings of yarn upwardly. The tube contact member 35 is maintained against the bias of the spring 36 in a raised position above the tube 3 due to the raised position of the suction slot portion 20 (which acts through its release arm 21 against the trip arm 22) and is thus in a position in which it is contacted by the upwardly moving windings of yarn which have been loosened from the top portion of the tube 3 by the jet nozzles 51. Thus, the tube contact member 35 advantageously minimizes the risk that the loosened windings of yarn will be driven off the tube 3 in an uncontrolled manner as well as minimizing the risk that the loosened windings of yarn will be snagged by another component of the yarn end preparation apparatus. Preferably, the respective yarn package 4 is rotated about its axis by the rotation action of the rotation roller 8 during this step of loosening and removing bunch windings of yarn from the top of the tube 3.

In correspondence with the loosening and release of a so-called bunch winding from the respective yarn package 4, the control unit 76 controls the drive motor 75 to effect downward movement of the suction housing 17 along the cylindrical rods 15. The drive motor 75 drives the worm gear of the worm gear assembly 74 to effect rotation of the output disk 71 in a clockwise direction and this produces corresponding clockwise pivoting of the arm 70 and corresponding clockwise pivoting of the second linkage member 60 about the conduit 61 on which it is rotatably supported. The first linkage member 56 is correspondingly downwardly driven by the second linkage member 60 and the first linkage member 56 effects corresponding downward travel of the suction housing 17 along the cylindrical rods 15.

In correspondence with the downward movement of the suction housing 17, the conventional suction source is activated to apply suction through the suction slot 23 and the control unit 76, as well, controls the valve 28 to effect the supply of pressurized air through, the conduit 27 to the jet nozzles 26. As the suction housing 17 is lowered, the suction slot 23 moves downwardly in correspondence therewith along a path parallel to the axis of the respective yarn package 4 and the spacing between the suction slot 23 and the tapered top portion 4' of the respective yarn package 4 correspondingly decreases. The downward movement of the suction housing 17 is coordinated with the operation of the jet nozzles 51 to insure that the jet nozzles 51 are no longer applying jets of pressurized air to the tube 3 before the tube contact member 35 has been lowered into contact with the top of the tube 3 and this coordinated operation prevents clamping of the loosened bunch winding between the tube contact component 35 and the top of the tube 3.

The yarn end preparation apparatus operates to automatically position the suction slot 23 at a predetermined spacing from the tapered top portion 4' of the respective yarn package 4 irrespective of the axial position of the tapered top portion on the tube 3. This automatic positioning of the suction slot 23 is accomplished through the detecting operation of the light beam emitting and detecting members 25,25'. The light beam emitting member 25 emits a light beam transversely into the spacing between the suction slot 23 and the tapered top portion 4' (e.g. generally parallel to the travel direction forwardly of the suction slot 23). Thus, as the suction slot portion 20 is lowered in a direction parallel to the axis of the yarn package, the tapered top portion 4' eventually interrupts the light beam and the light beam detecting member 25' correspondingly transmits a signal to the control unit 76 indicating that an interruption of the light beam has occurred. In response to this signal, the control unit 76 controls the drive motor 75 to cease its driving operation, thereby effecting a cessation of the movement of the linkage members 56,60 and a stoppage of the suction housing 17 at its instantaneous position on the cylindrical rods 15.

In correspondence with the positioning of the suction slot portion 20 at the selected optimal spacing from the tapered top portion 4', pressurized air is jetted by the jet nozzle 26 onto the outer surface of the tapered top portion 4' to effect loosening of a yarn end therefrom and the upward tangential direction of the jet streams act to loosen and drive a yarn end upwardly and outwardly away from the tapered top portion so that the loosened yarn end is reliably subjected to the suction being applied through the suction slot 23 for drawing in of the loosened yarn end through the suction slot. The projections in which the suction slot detecting members 25,25' are mounted on each side of the suction slot 23 provides an overall concave shape to the side of the suction slot portion 20 facing the tapered top portion 4' to thereby guide the streams of pressurized air jetted by the jet nozzles 26 into tangential engagement with the outer surface of the tapered top portion 4'. The overall concave shape of the suction slot side of the suction slot portion 20 thus approximates the curvature of the outer surface of the yarn on the tapered top portion 4' and thereby facilitates the loosening action of the applied jet streams and the suction action of the suction applied through the suction slot 23.

The interaction of the release arm 21 on the suction slot portion 20 and the trip arm 22 projecting from the tube contact member 35 is coordinated such that the tube contact member 35 is lowered into engagement with the top of the tube 3 of the respective yarn package 4 slightly prior to the positioning of the suction slot 23 at the selected optimal spacing from the tapered top portion 4'. Additionally, the control unit 76 controls the rotation drive motor 8' to rotate the rotation roller 8 in a direction which effects unwinding rotation of the respective yarn package 4 in correspondence with the engagement of the tube 3 by the tube contact member 35. The respective yarn package 4 is accordingly contemporaneously rotated in the unwinding direction as the suction slot 23 reaches its selected optimum spacing from the tapered top portion 4'.

If a yarn end is successfully loosened from the tapered top portion 4', the suction action applied through the suction slot 23 draws the loosened yarn end through the suction slot 23, through the suction slot portion 20, the carriage portion of the suction housing 17, the interconnecting conduit 55, the first linkage member 56 and into the second linkage member 60 in which the drawn in yarn end interrupts the light beam emitted by the light beam emitting component 62'. In response to the light beam interruption, the yarn end cutting device 63 is activated to cut the drawn in yarn end and, if the yarn end cutting device 63 is of the type having suction passage blocking members which simultaneously block the passage of suction past the yarn end cutting device in correspondence with the cutting of the yarn end, the cut length of the drawn in yarn end extending between the yarn end cutting device 63 and the respective yarn package 4 is no longer subject to suction action.

If the yarn end preparation apparatus is additionally provided with a conventional yarn end clamping component within, for example, the portion of the second linkage member 60 adjacent the yarn end cutting device 63, the yarn end clamping component can be activated in coordination with the cutting of the drawn in yarn end to clamp the cut length of the drawn in yarn end and apply a predetermined pressure during subsequent winding of the yarn end onto the yarn package 4. The discard portion of the drawn in yarn end downstream of the yarn end cutting device 63 relative to the direction of flow of suction is drawn by the suction action to the suction source for disposal thereat.

In correspondence with the cutting of the drawn in yarn end, the control unit 76 controls the rotation of the rotation roller 8 to cease the unwinding rotation of the respective yarn package 4 and, additionally, controls the drive motor 75 to effect raising of the suction housing 17 to a position in which the upper end of the suction slot 23 is disposed shortly below the top of the tube 3 and above the top of the tapered top portion 4'. The control unit 76 then controls the rotation roller 8 to rotate the respective yarn package 4 in a winding direction opposite to its unwinding direction of rotation and this winding rotation of the yarn package effects winding of the drawn in yarn end onto the exposed top portion of the tube 3 with the upper end of the suction slot 23 operating as a yarn guide which reliably guides the yarn end onto the tube 3. The yarn end is preferably under a predetermined tension during its winding onto the tube 3 and the predetermined tension can be provided, for example, by the appropriate application of suction to the length of yarn end in the first linkage member 56 or, alternatively, by the compressive action of the conventional yarn end clamping device, if such a device is provided.

The control unit 76 controls the auxiliary yarn end loosening device to supplement the yarn end loosening process in the event that the light beam detecting component 62 has not detected an interruption of the light beam (thereby signaling the presence of a drawn in yarn end) before the lapse of a predetermined period of time. In this event, the control unit 76 controls the drive motor 41 to rotate the eccentrically mounted disk 40 in a counter-clockwise direction, thereby effecting cyclically reversing pivoting of the arm 42 about the pivot shaft 45. During pivoting of the arm 42 in a clockwise direction, the abrasive member 47 moves downward along the outer surface of the tapered top portion 4' and, conversely, during pivoting of the arm 42 in a counter-clockwise direction, the abrasive member 47 is raised out of engagement with the outer surface of the tapered top portion 4'. The downward movement of the abrasive member 47 along the tapered top portion 4' mechanically works the yarn to effect loosening of a yarn end from and the downward movement of the abrasive member advantageously minimizes the risk that a loosened yarn end will be driven toward the top of the tube 3. Since the tapered top portion 4' increases in diameter in a direction from the top of a tube 3 towards its bottom, the risk is minimized that a yarn end loosened by the abrasive member 47 will be pushed downwardly beyond the tapered top portion 4'.

The control unit 76 is configured to effect stopping of the mechanical working operation of the auxiliary yarn end loosening device after the lapse of a predetermined period of time. Additionally, the control unit 76 is configured to control the release of the respective yarn package 4 for further transport by the transport assembly 5 in response to the passage of a predetermined period of time following the receipt of a signal from the light beam detecting component 62 indicating that a yarn end has been successfully loosened and drawn into the linkage members 56,60. The predetermined time following the receipt of the signal from the light beam detecting component 62 is selected to be a sufficient amount of time for the step of re-winding the drawn in yarn end onto the respective yarn package 4 to be completed. The control unit 76 can also be configured to effect the release of the respective yarn package 4 for further transport away from the preparation location in the event that no signal from the light beam detecting component 62 has been received before the lapse of a predetermined period of time, in which event the yarn package 4 is deemed to be an unpreparable yarn package.

Since the period of time during which each yarn package 4 is positioned at the preparation location individually varies according to the length of time before the light beam detecting component signals the presence of a drawn in yarn end (or, in the event that no yarn end is successfully drawn in, the lapse of the predetermined time during which a signal from the light beam component 62 is awaited), the processing capability of the yarn end preparation apparatus is only dependent upon the actual time required to prepare each yarn package, in contrast to an arrangement in which each yarn package remains at the preparation location for a predetermined period of time irrespective of the lapse of actual time before a yarn end has been successfully drawn in and rewound on the yarn package.

The yarn end preparation apparatus is also configurable to insert a yarn end into the tube 3 of the respective yarn package 4. In this configuration, the control unit 76 controls the movement of the suction housing 17 to effect positioning of the suction slot portion 20 at a position in which its lower end is higher than the top of the tube 3. Additionally, the suction slot portion 20 is provided with appropriate conventional means such as, for example, a conventional hydraulic cylinder and piston assembly, which is controlled by the control unit 76 to effect pivoting of the suction slot portion 20 about the axis of the pivot 18 to a predetermined disposition in which the lower end of the suction slot 23 is closely adjacent the axis of the respective yarn package 4. Through the operation of a conventional suction device (not shown) operable to produce suction through the tube 3, a drawn in yarn end can be drawn into the tube 3. In lieu of a conventional suction device, an arrangement could also be provided in which a stream of pressurized air is directed through a hollow through bore in the cylindrical rod 33 and the tube centering component 35 to thereby propel a yarn end into the tube 3.

As seen in FIG. 3, the yarn end preparation apparatus of the present invention is also operable in a yarn stripping role in which it strips the remaining yarn on a partially wound bobbin. In operation, the partially wound yarn package 4 is positioned at the preparation location and the control unit 76 controls the drive motor 75 to effect lowering of the suction housing 17 along the cylindrical rods 15 to a position in which the roller 29 on the back side of the suction slot portion 20 is engaged by the sloped free end portion 16' of the pivot promoting bracket 16. As the roller 29 rolls along the sloped free end portion 16', the suction slot portion 20 is thereby pivoted in a clockwise direction about the axis of the pivot 18 and this pivoting movement brings the suction slot 23 closely adjacent the remaining body of yarn on the yarn package. Thereafter, suction applied through the suction slot 23 effects drawing in of a yarn end from the partially wound yarn package and the control unit 76 controls the suction operation until the yarn has been completely drawn off (or stripped) from the yarn package, thereby leaving only an empty tube 3 supported on the caddie 1 at the preparation location.

The yarn end preparation apparatus is particularly well-suited for preparing the yarn end of those yarn packages which cannot be prepared by conventional yarn end preparation techniques or which have already been handled by a conventional yarn end preparation device without the successful preparation of a yarn end of the yarn package. Additionally, the yarn end preparation apparatus is particularly well-suited for preparing yarn packages having a body of yarn different than other yarn packages prepared sequentially therewith such as, for example, a yarn package produced at the completion of a batch of yarn packages which comprises a lesser amount of yarn than the previously built yarn packages.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for preparing an end of yarn of a textile yarn package, the yarn package having a body of yarn formed on a tube, the tube having one end and an opposed end and the body of yarn having at least one tapered portion tapering inwardly from an inclined transition location toward a respective end of the tube, the yarn end preparing apparatus comprising:

means for applying suction including a suction housing forming a suction slot through which suction is applied to a yarn package to effect drawing of a yarn end of the yarn package through the slot interiorly of the suction housing, the slot being of a narrow elongated configuration and having a lengthwise dimension at least approximately corresponding to the axial dimension of the tapered portion of the yarn package;

means for automatically positioning the suction slot at a predetermined spacing from the tapered portion of the body of yarn of the yarn package independent of the axial position of the inclined transition location at which the tapered portion of the body of yarn tapers inwardly, the automatically positioning means including means for moving the suction housing in a guided direction in which the suction slot is moved from a start position axially beyond the respective end of the tube toward the other end of the tube to thereby narrow the spacing between the suction slot and the tapered portion of the yarn package generally parallel to the axis of the yarn package, a light beam emitting component mounted to the suction housing at an orientation for emitting a light beam along a path into the spacing between the tapered portion of the yarn package and the suction slot, a light beam detecting component mounted to the suction housing and operable to generate a stop movement signal in response to an interruption of the light beam emitted by the light beam emitting component, and control means, operatively connected to the light beam detecting component, for controlling the means for moving the suction housing to stop the guided movement of the suction housing solely in response to the receipt of a stop movement signal from the light beam detecting component, whereby the means for moving the suction housing is operable to move the suction housing from the start position to narrow the spacing between the suction slot and the tapered portion of the yarn package and the light beam detecting component is operable to generate a stop movement signal upon narrowing of the spacing between the suction slot and the tapered portion of the yarn package to an extent at which the yarn package interrupts the light beam and the controlling means is operable to stop the suction housing with the suction slot positioned at the predetermined spacing from the tapered portion of the yarn package in response to receipt of the stop movement signal form the light beam detecting component; and means for repositioning the suction slot portion after drawing in the yarn end into the suction applying means for depositing the drawn in yarn end at a predetermined location on the yarn package suitable for further processing of the yarn package at a subsequent processing station.

2. An apparatus according to claim 1 wherein the automatically positioning means includes means for adjustably orienting the suction slot at a predetermined inclination corresponding to the inclination of the tapered portion of the body of yarn of the yarn package.

3. An apparatus according to claim 1 and further comprising mounting means for mounting the light beam emitting component and the light beam detecting component on respective opposite lateral sides of the suction slot at a spacing from the suction slot toward the package wherein a light beam emitted by the light beam emitting component travels transversely across the spacing between the suction slot and the tapered portion of the yarn package.

4. An apparatus according to claim 3 wherein the mounting means includes a pair of projecting portions formed on the suction housing, each projecting portion being disposed on a respective lateral side of the suction slot and supporting a respective one of the light beam emitting component and the light beam detecting component.

5. An apparatus according to claim 1 wherein the movably supporting means includes at least one vertical guide member along which the suction housing is relatively moved and the drive means includes means for driving the suction housing relatively along the vertical guide member at variable speeds.

6. An apparatus according to claim 5 wherein the drive means includes a motor operatively connected to the detecting means and first and second linkage members, the first linkage member having one end movably connected to the suction housing and its other end movably connected to an end of the second linkage member and the second linkage member is operatively coupled to the motor for driving of the second linkage member to effect guiding movement of the suction housing relatively along the vertical guide member of the movably supporting means.

7. An apparatus according to claim 6 wherein the motor has an output shaft and the drive means includes a disk mounted to the output shaft of the motor and having a plurality of magnets mounted thereto along a circumferential portion thereof, each magnet having an opposite polarity than the respective adjacent magnet, and magnet sensing means for sensing movement therepast of the magnets during rotation of the output shaft motor, and the control means is operatively connected to the magnet sensing means for controlling the operation of the motor in response to sensing of the magnets by the magnet sensing means.

8. An apparatus according to claim 6 wherein each linkage member includes a conduit means forming a conduit, the conduit means of the first linkage member being communicated with the suction housing and the conduit means of the second linkage member being communicated with a suction source for applying suction through the conduit means of the first and second linkage members and the suction slot to thereby effect the drawing in of a yarn end through the suction slot and into at least the conduit means of the first linkage member.

9. An apparatus according to claim 8 wherein the second linkage member is pivotably mounted to a pivot and the drive means includes a crank arm having one end fixedly mounted to a drive shaft of the drive motor and another end pivotably mounted to the second linkage member at a spacing from the pivot for driving the pivot of the second linkage member about the pivot.

10. An apparatus according to claim 9 wherein the drive means includes a worm gear assembly and a drive linkage operatively interconnecting the worm gear assembly with the second linkage member, the drive motor being operable to drive the worm gear assembly.

11. An apparatus according to claim 8 and further comprising a conduit communicating the suction source with the second linkage member, the second linkage member having means for movably mounting the second linkage member on the conduit.

12. An apparatus according to claim 8 and further comprising means for cutting a drawn in yarn end, the yarn end cutting means being mounted in the conduit means of a selected one of the first and second linkage members for cutting a yarn end drawn into the conduit means of the selected linkage member.

13. An apparatus according to claim 1 wherein the suction housing includes a carriage portion movably supported by the movably supporting means and a suction slot portion pivotably mounted to the carriage portion, and means for adjustably orienting the suction slot at a predetermined inclination corresponding to the inclination of the tapered portion of the body of yarn of the yarn package, the adjustably orienting means including means for adjustably varying the angular orientation of the suction slot portion relative to the carriage portion.

14. An apparatus according to claim 13 and further comprising means for effecting pivoting of the suction slot portion to a predetermined angular orientation relative to the carriage portion, the pivot effecting means being positioned relative to the movably supporting means for effecting pivoting of the suction slot portion relative to the carriage portion to a selected angular orientation and including an inclined surface, the inclined surface of the pivot effecting means effecting pivoting of the suction slot portion relative to the carriage portion.

15. An apparatus according to claim 14 wherein the suction slot portion includes a roller for rolling travel along the inclined surface of the pivot effecting means.

16. An apparatus according to claim 1 and further comprising jet nozzle means mounted to the suction housing and pressurized air supply means operatively connected to the jet nozzle means, the jet nozzle means for applying pressurized air tangentially to the body of yarn of the yarn package to effect loosening of a yarn end therefrom.

17. An apparatus according to claim 1 and further comprising means for mechanically working the yarn package, the mechanically working means being mounted to the suction housing and including means for moving the mechanically working means relative to the outer surface of the body of yarn of the yarn package to effect mechanical working of the yarn package.

18. An apparatus according to claim 17 wherein the mechanically working means includes an abrasive surface and means for cyclically moving the abrasive surface into and out of contact with the outer surface of the body of yarn of the yarn package.

19. An apparatus according to claim 18 wherein the means for cyclically moving the abrasive surface includes a drive disk mounted for eccentric rotation, one end of the drive arm pivotably secured to the drive disk and an opposed end of the drive arm supporting the abrasive surface, and pivot support means pivotably mounted to the drive arm at a location spaced from the one end of the drive arm pivotably coupled to the drive disk, the drive disk being operative to cyclically reversibly pivot the drive arm relative to the pivot support member to thereby effect cyclic movement of the abrasive surface toward and away from the yarn package and the abrasive surface being positioned for contacting the yarn package upon downward movement of the abrasive surface.

20. An apparatus according to claim 18 wherein the suction applying means includes yarn end detecting means for detecting the presence or absence of a yarn end drawn into the suction applying means, the control means being operable to activate the mechanically working means in response to the absence of a signal from the yarn end detecting means indicating the presence of a yarn end before the lapse of a predetermined period of time.

21. An apparatus according to claim 1 and further comprising tube jet nozzle means, the tube jet nozzle means being operable to direct pressurized air against the tube of the yarn package to effect loosening and separation of a winding of yarn thereon.

22. An apparatus according to claim 21 and further comprising a yarn winding release control means positionable axially beyond the respective end of the tube of the yarn package for engaging a yarn winding driven beyond the respective end of the tube by the tube jet nozzle means.

23. An apparatus according to claim 22 wherein the yarn winding release control means is mounted to the suction housing for movement therewith and includes means for engaging the respective end of the tube of the yarn package to maintain the yarn package at a predetermined inclination during handling thereof by the yarn end preparing apparatus.

24. An apparatus according to claim 1 further comprising control means for controlling the drive means to move the suction housing along the movably supporting means to a position in which a yarn end drawn into the suction applying means is supported relative to the yarn package for winding onto the yarn package at a predetermined location thereon and further comprising means rotating the yarn package in a winding direction to wind a supported by the suction applying means onto the yarn package at the preferred location thereon.

25. An apparatus for preparing an end of yarn of a textile yarn package, the yarn package having a body of yarn formed on a tube, the tube having one end and an opposed end and the body of yarn having at least one tapered portion tapering inwardly form an inclined transition location toward a respective end of the tube, the yarn end preparing apparatus comprising:

means for applying suction, the suction applying means including a suction slot portion forming a slot through which suction is applied to a yarn package to effect drawing of a yarn end of the yarn package through the slot interiorly of the suction slot portion, the slot being of a narrow elongated configuration and having a lengthwise dimension at least approximately corresponding to the axial dimension of the tapered portion of the yarn package, a carriage portion to which the suction slot portion is movably mounted for movement about a movement axis, means for movably supporting the carriage portion for guided movement thereof in a direction in which the carriage portion is moved generally parallel to the axis of the yarn package and drive means for moving the carriage portion along the movably supporting means;

means for re-orienting the suction slot at a predetermined inclination corresponding to the inclination of the tapered portion of the body of the yarn package from an inclination different from the predetermined inclination, the re-orienting means being operable to effect movement of the suction slot portion about the movement axis in correspondence with movement of the carriage portion along a selected portion of the movably supporting means, whereby the suction slot can be positioned for drawing in a yarn end on the tapered portion of the body of the yarn package into the suction applying means; and means for repositioning the suction slot portion after drawing in the yarn end into the suction applying means for depositing the drawing in yarn end at a predetermined location on the yarn package suitable for further processing of the yarn package at a subsequent processing station.

26. An apparatus according to claim 25 and further comprising means for cutting a drawn in yarn end wherein the yarn end cutting means includes means for blocking the conduit means of the selected linkage member in correspondence with the cutting of a yarn end by the yarn end cutting means, the blocking means being operable to block the flow of suction past the location at which the yarn end cutting means cuts a drawn in yarn end.

* * * * *